US005755648A

United States Patent [19]

Kildani

[11] Patent Number: 5,755,648

[45] Date of Patent: May 26, 1998

[54] HAND EXERCISER WITH ATTACHED OBJECT

[76] Inventor: Paul Kildani, 315 First St., Ste. U-190, Encinitas, Calif. 92024

[21] Appl. No.: 703,068

[22] Filed: Aug. 26, 1996

[51] Int. Cl.[6] ..... A63B 21/02; A63B 23/16

[52] U.S. Cl. ..... 482/121; 482/44

[58] Field of Search ..... 482/121, 83, 84, 482/86, 87, 89, 44; 70/456 R, 457, 459, 456 B; 273/415, 423–430; 224/919; D21/204, 206, 62; 24/92, 113 R, 114.4, 114.7, 114.9, 114.12

[56] References Cited

U.S. PATENT DOCUMENTS

| | | | |
|---|---|---|---|
| 2,836,869 | 6/1958 | Adinolfi | 24/113 R |
| 3,214,811 | 11/1965 | Adinolfi | 24/113 R |
| 3,242,544 | 3/1966 | Dritz | 24/113 R |
| 3,601,923 | 8/1971 | Rosenberg . | |
| 4,100,779 | 7/1978 | Schachter | 70/456 R |
| 4,174,107 | 11/1979 | Hickey | 473/423 |
| 4,627,611 | 12/1986 | Kauffman | 482/86 |
| 4,752,072 | 6/1988 | Parsons | 463/47.4 |
| 4,877,166 | 10/1989 | Gelinas, Jr. | 473/415 |
| 4,952,190 | 8/1990 | Ternoff et al. . | |
| 4,953,852 | 9/1990 | Donohue | 482/87 |
| 5,026,054 | 6/1991 | Osher et al. . | |
| 5,035,425 | 7/1991 | Edwards . | |
| 5,183,154 | 2/1993 | Slemp | 224/919 |
| 5,190,504 | 3/1993 | Scatterday . | |
| 5,350,342 | 9/1994 | Scatterday . | |
| 5,413,332 | 5/1995 | Montgomery . | |

FOREIGN PATENT DOCUMENTS

| | | | |
|---|---|---|---|
| 3123055 | 1/1983 | Germany | 70/456 R |

*Primary Examiner*—Richard J. Apley
*Assistant Examiner*—Denise Pothier
*Attorney, Agent, or Firm*—Rothwell, Figg, Ernst & Kurz

[57] ABSTRACT

A hand held exerciser and key chain assembly includes a ball body having a plurality of elastomeric balloon layers and a particulate material packed within an innermost balloon layer. The balloon layers each have an opening therethrough. An inner attachment member having an outer diameter greater than the diameter of at least the opening of the outermost balloon layer is situated within at least the outermost balloon layer. An outer attachment member is snap engaged to the inner attachment member. A loop is connected to one of the attachment members and extends through the opening in at least the outermost balloon layer. A key chain is attached to the loop. As a result, an interesting and structurally sound hand held exerciser with key chain assembly is created.

15 Claims, 3 Drawing Sheets

FIG. 2(A)
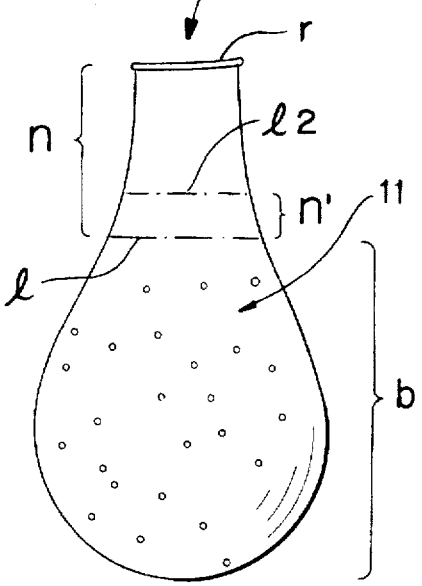
FIG. 2(B)
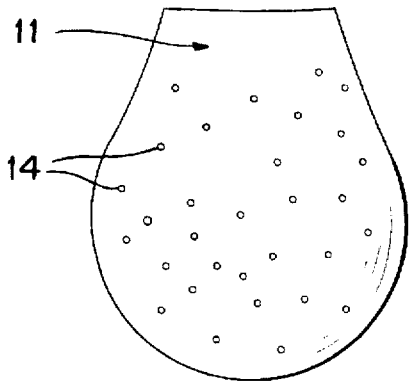
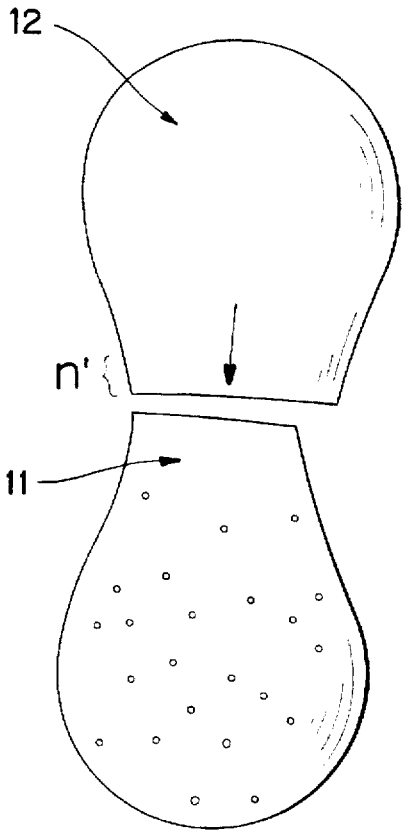
FIG. 2(C)
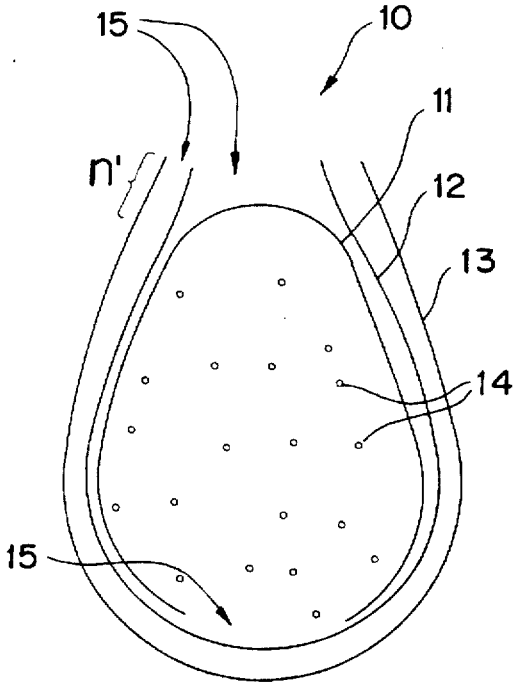
FIG. 2(D)

HAND EXERCISER WITH ATTACHED OBJECT

BACKGROUND OF THE INVENTION

1. Field of the Invention

The present invention relates to hand exercisers and, in particular, to hand exercisers made from balloons filled with particulate material.

2. Description of the Background Art

A variety of hand exercisers are known in the art, such as those made of solid rubber and those made of elastomeric balloons filled with particulate material. Typically, such exercisers are used for physical exercise as well as for mental relaxation and therapeutic use. Known hand exercisers, including the filled balloon exercisers, are relatively non-interesting objects. They are usually round, or generally round, provide limited appeal, and are relatively undesirable to carry (such as in one's pocket) for extended periods of time. Moreover, due to their small size and limited functionality, they are easily misplaced and/or lost.

Exemplary filled balloon type hand exercisers are the SHARPER IMAGE DEADBALL (TM) and the exerciser described in U.S. Pat. No. 5,350,342 (Scatterday). The SHARPER IMAGE DEADBALL (TM) is similar to that of Scatterday and was on sale prior to the filing date thereof. Scatterday '342 shows an exerciser which is made with a plurality of latex layers 6–14. As discussed on column 3 of the reference, construction of the device involves the following: "[P] articulate material and lubricant that make up the core are initially inserted through hole 20 of the first latex layer 6 . . . This procedure is then repeated with the remaining layers . . . Once the core has been inserted in the final layer, glue is placed around the perimeter of hole 20 of layer 14 to fix the latex surrounding the hole to the underlying layer."

Among other problems, the Scatterday type device has problems pertaining to the filler used. Column 3, lines 10 et seq., of Scatterday states: "In practice, seeds such as millet have been used as the particles. As an alternative, the particles can be hard plastic or silicon beads or any other matter that is similar in size and shape to millet and that is hard enough to withstand compressive pressures . . ."

However, seeds such as millet disintegrate over time, damaging and/or altering the functioning thereof. Further, millet has a relatively large size such that its shape is seen through the stretched balloon layers imparting a pocked, or pimpled, appearance to the exerciser.

In addition, millet typically has a tear-like shape and sharp ends which can puncture the balloons. Thus, the use of such irregularly shaped particles can damage the balloons. Due to the thinness and the high elasticity of the balloon layers, known balloon filled exercisers have had a tendency to prematurely break or rupture—resulting in the release of particulate material therefrom.

SUMMARY OF THE INVENTION

The present invention overcomes the above-noted and other problems pertaining to existing hand exercisers, and, in particular, pertaining to filled balloon hand exercisers.

According to a first aspect of the invention, a hand exerciser is provided which includes an exercise ball having a plurality of elastomeric balloon layers and a particulate material filled within an innermost one of the balloon layers, at least an outermost one of the layers having an opening therethrough, attachment hardware having an outer clamping member and an inner clamping member clamping at least the outermost balloon around the perimeter edge of the opening, the attachment hardware including a connecting member for attachment to an external member, the connecting member being directly fixed to either the inner clamping member or the outer clamping member.

According to a second aspect of the invention, the hand exerciser includes an external object, preferably a key chain, attached to a loop-shaped connecting member.

According to a third aspect of the invention, the hand exerciser includes indicia, such as a logo, printed on an outer surface of an outermost one of the balloon layers.

According to a further aspect of the invention, a method of fabricating the hand exerciser includes the steps of: a) filling a particulate material inside a first elastomeric balloon, b) placing at least a second elastomeric balloon around the first elastomeric balloon so as to create a plurality of balloon layers, c) placing an inner clamping member inside an opening in at least the outermost balloon, d) clamping at least the outermost balloon around the perimeter edge of the opening between an outer clamping member and the inner clamping member, e) attaching an external object to a connecting member which is directly fixed to either the inner clamping member or the outer clamping member.

The present invention has notable advantages and uses which are not found in other known devices. For better appreciation, some of the advantages are listed below. Some of the below listed advantages are attributable to further aspects of the invention discussed below.

First, the preferred construction of the present invention enables an object to be fixedly attached to the balloon(s), creating a fun and interesting assembly, while avoiding tearing or damaging of the balloon(s), despite the difficulties involved in attaching an object to a thin elastomeric material.

Second, the present device can be easily and inexpensively manufactured from readily available parts, reducing the need to develop machinery, etc.

Third, the clamping members can, in a preferred construction, be snap engaged, which is clean (e.g. adhesives are not required) and easy to effect by hand. Thus, no other parts are needed which would require separate handling and/or manipulation. Because of the snap fit engagement, the product can, in an alternative embodiment, be designed to be un-snapped, such that a product having an incorrect or otherwise undesirable outer balloon covering can be readily modified by replacing the outer balloon. Alternatively, one or more additional balloons can be placed thereover -such as to cover old, undesirable logos, or to add strength thereto.

Fourth, by attaching a key chain, the present device is less likely to be misplaced and/or lost.

Fifth, the present device has a refined visual appearance—that of a "finished" quality product—created by the attachment hardware connection at the balloon opening(s). This is in contrast to devices such as in Scatterday (above), wherein the outer layer is "glued" around its opening, creating an image of a "cheap" and "unfinished" product, and allowing the user to discern that the product is constructed from inexpensive balloons.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which:

FIGS. 2(A)–2(D) illustrate stages during the fabrication of a preferred embodiment of a ball body of the invention;

FIG. 3(A) is a top view of an inner attachment member,

FIG. 3(B) is a bottom view of an outer attachment member,

FIG. 3(C) is a side view of the inner attachment member,

FIG. 3(D) is a side view of the outer attachment member,

FIG. 3(E) is cross-sectional view of a portion of the attachment hardware in a locked condition, and FIG. 3(F) is a side view illustrating the assembly of the attachment hardware to the ball body.

DETAILED DESCRIPTION OF THE INVENTION

Figure 1:
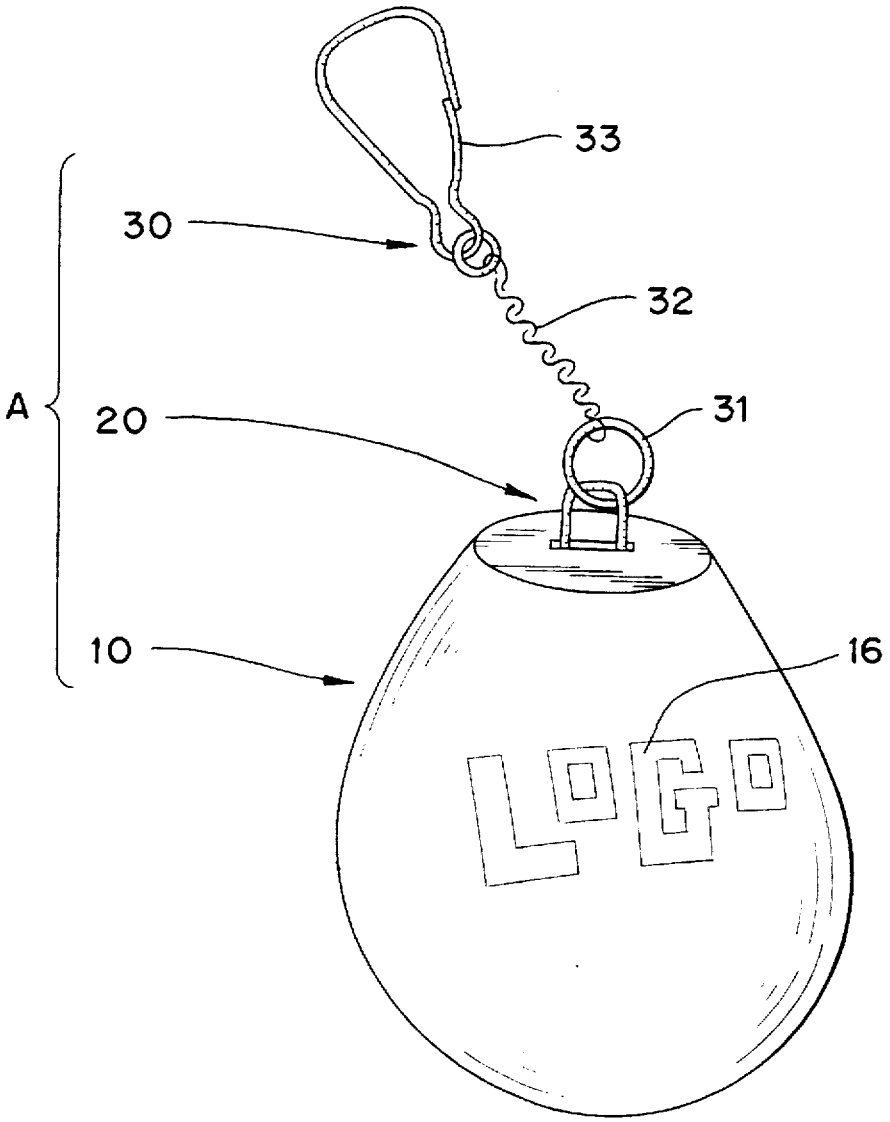
FIG. 1 is a perspective view of an assembly according to a preferred embodiment of the invention.

FIG. 1 illustrates an assembly A according to a preferred embodiment of the invention including a ball body 10, attachment hardware 20, and a key chain 30.

The ball body 10 is a resilient body which can be held in one's hand and squeezed for relaxation and/or exercise of one's hand muscles. The attachment hardware 20 is mounted to the ball body 10 and provides a means for mounting the key chain 30 to the ball body 10.

Ball Body

As shown in FIG. 2(D), the preferred ball body 10 includes a plurality of balloons 11, 12, 13 and a particulate material 14 packed inside the innermost balloon 11.

FIGS. 2(A)–2(D) illustrate the construction of the ball body 10. As shown in FIG. 2(A), a balloon 11 made of a polymeric material having a significant elasticity, such as latex elastomer, is used. Preferably, the balloon is of the common type having a shape (in an empty state) generally as shown in FIG. 2(A) with a generally rounded, or fuller, body section b extending from a narrow neck portion n with an outer bead rim r. The neck n and bead rim r are commonly used to facilitate (a) inflation of the balloon with air by attachment to a nozzle or placement within one's mouth and (b) closing of the balloon by tying to trap air therein.

Preferably, the body section b is about 2 to 3 inches long and has a volume of about ⅓ cup (76 cc) when fully packed without being substantially elastically expanded. Appropriate balloons are readily available, such as that manufactured by Pioneer Balloon Company, model 9" round.

To begin the construction of the ball body 10, a balloon 11 is filled with a particulate material 14 (FIG. 2(A)). Preferably, the particulate material has a diameter of about 0.001 to 0.04 inches. Preferred materials include sand, baking soda, corn starch, flour, glass beads, plastic beads, metal beads, and the like. Preferably, the material is substantially non-compressible by hand and is generally free flowing (most preferably spherical in shape), whereby the squeezing pressure of one's hand imparts a force on the balloon layers which in turn impart an appropriate restoring elastic force.

Preferably, the particulate material is sized such that when the device is squeezed, the material is not visually apparent beneath the balloon body surface. The use of very small, round, and smooth particulate material eliminates the problems of (a) tearing, (b) filler disintegration and (c) undesirable appearance thereof beneath the surface.

After the balloon 11 is filled, the balloon 11 is cut at the juncture between the neck portion n and the body portion b along the line L (FIG. 2(A)) to remove the neck portion. Alternatively, the neck portion n can also be removed prior to filling. However, cutting the neck portion after filling facilitates handling during and after filling. In addition, if filled prior to cutting, one can raise or lower the line L depending on the amount of material actually filled—e.g. to maintain a proper level of material. The remaining neck portion is tucked into the body portion, which prevents the particulate material from spilling out.

Thereafter, a second balloon 12 (of similar construction) is cut along a line L2, shown in FIG. 2(A), such that a slight neck portion n' remains.

As shown in FIG. 2(C), the second balloon 12 is stretched over the first balloon 11. The opening 15 of the second balloon is, preferably, located at an opposite side to the opening 15 of the first balloon.

Thereafter, a third balloon 13 (of similar construction) is cut along a similar line L2 (FIG. 2(A)) to create a similar short neck portion n'. As shown in FIG. 2(D), the third balloon 13 is, preferably, wrapped over the second balloon 12 with its opening aligned with that of the second balloon 12. The third, outermost, balloon 13 can have a logo 16 (FIG. 1) pre-printed thereon, or can otherwise be colored and/or decorated prior to assembly.

Three balloons are used in the most preferred construction. However, additional balloons, aligned with the second and third balloons, can be added outside the third balloon. Alternatively, the third balloon 13 can be eliminated. In addition, inner balloons 11' can be added, e.g. an inner balloon oppositely oriented to the balloon 11. In this latter case, the balloons 11, 11' would, preferably, each be cut along lines L so as to remove the neck portions n. Alternatively, a single balloon can be used to construct the ball body, the attachment hardware preventing particulate material from escaping through the balloon opening. Preferably, the single balloon would be made of a durable latex elastomer.

Attachment Hardware

Figure 3A:
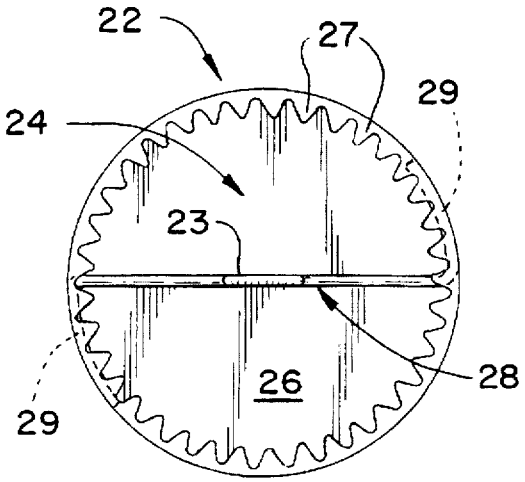
FIGS. 3(A)–3(F) illustrate a preferred embodiment of the attachment hardware of the invention, more specifically.
Figure 3B:
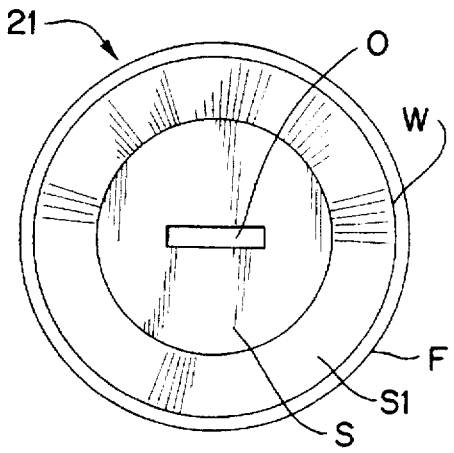
Figure 3C:
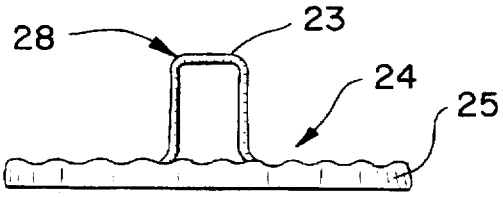
Figure 3D:
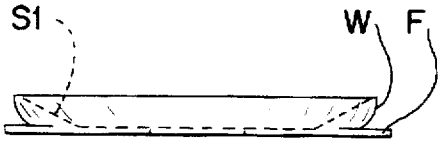
Figure 3E:
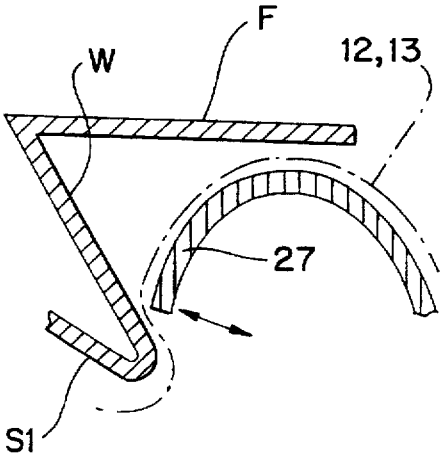
Figure 3F:
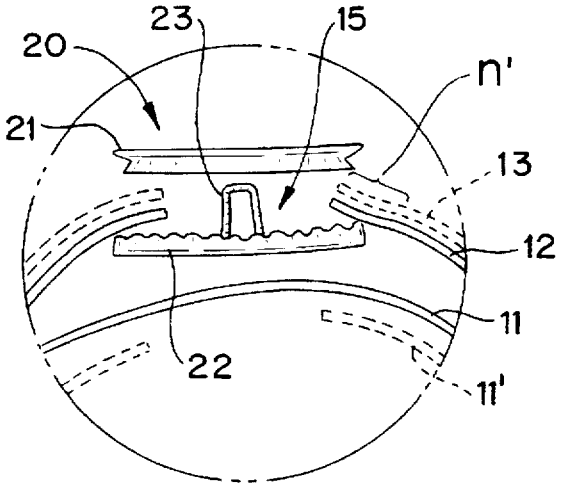

As shown in FIG. 3(F), the attachment hardware 20 includes an outer attachment member 21 and an inner attachment member 22 which receive a portion of the balloons 12 and 13 therebetween and close the openings 15 therein.

As shown in FIGS. 3(A) and 3(C), the inner attachment member 22 preferably includes a bowl 24 having an annular sidewall 25 and a bottom 26, a plurality of resilient teeth 27 extending inward and downwards from the top of the sidewall 25, and an attachment loop 23.

Preferably, the loop 23 is formed by a bent wire 28 which extends across the bottom 26, curves upwards in the middle to form the loop 23, and curves oppositely at both ends 29 along the inside of the sidewall 25 beneath the teeth 27 so as to fixedly hold the wire to the inner attachment member without adhesives, etc. Although less preferred, the loop can alternatively be attached to the outer attachment member.

As shown in FIGS. 3(B) and 3(D), the outer attachment member preferably includes an outer flange F, an outwardly inclined engagement wall W, and an inner disc-surface S with a slot 0 therethrough.

The inner and outer attachment members 21, 22, including the loop 23, are preferably made of a generally rigid and generally strong material. Preferably, it is made of a metal, such as aluminum, but it can also be constructed of a hard plastic, or other suitable material.

In the preferred construction shown in FIG. 3(E), the inner attachment member 22 is initially placed inside the balloon layer 12, and the neck portion n' is stretched therearound. The inner attachment member is preferably placed inside the balloon layer 12 prior to wrapping the balloon layer 13 thereover. The inner attachment member can be "retained" in place by the resiliency of the balloon layer(s), making fabrication easy.

Once the inner attachment member is within the balloons, the neck portions n' of the balloons 12, 13 are tucked inside the bowl 24. Then, the outer attachment member 21 is snapped to the inner attachment member 22 so that the balloon neck portions n' of the second and third balloons are sealed inside and between the inner and outer attachment members. Snapping, or clamping, the two members together is facilitated because gripping both sides of the attachment hardware is enabled due to the "stretchability" of the balloons and to the free flowing of the particulate material—e.g. it is easy to grasp below the inner attachment member.

Preferably, the inner disc-surface S includes an inclined wall section S1 providing addition space within the attachment hardware to receive the neck portions n'.

The diameter across the inner attachment member between the inner ends of the teeth 27 is slightly less than the diameter across the outer attachment member between the upper ends of the wall W (lower end as shown in FIG. 3(E)). As a result, the top of the wall W abuts the teeth 27 when pressed thereagainst, and the teeth deflect (see arrows in FIG. 3(E)) until the pieces snap together to a locked position wherein the teeth 27 press towards and/or lock behind the wall W and wherein the flange F covers the teeth 27 and extends toward or over the sidewall 25. The teeth can be used to firmly grasp the elastomeric balloons to effect a firm hold. The teeth are, preferably, slightly rounded at the ends thereof such that they do not penetrate/tear the elastomeric balloons, but merely grip the balloon material.

Preferably, the diameter of the openings 15 in the balloons 12 and 13 created by cutting along the line L2 is less than that of the inner and outer attachment members, such that the short neck portions n' will tend to bend around the inner attachment member and between the attachment members (such as to the position shown in FIG. 3(F)) to facilitate clamping therein.

As shown, in the preferred construction, the openings 15 and the inner and outer attachment members are generally circular. This helps to evenly distribute tensile forces that could damage the balloons 12 and 13 around the attachment hardware and around the holes 15. However, non-circular shapes are also contemplated. Nevertheless, such other shapes preferably should have rounded edges.

The above construction enables an object to be fixedly attached to the balloons in a manner to avoid tearing or damaging the balloons, despite the fact that it is very difficult to attach an object to a thin elastomeric material.

Utilization of the above-described preferred embodiment of the attachment hardware is preferred because, as with the balloons, such attachment hardware is widely commercially available as two-piece buttons for use in the garment industry; the "inner attachment member" being the button front, and the "loop" being that used for stitching the button to an article of clothing, etc. Accordingly, manufacture of the present device is highly simplified and involves the application of available, inexpensive, components in such a novel manner as to create a unique and high quality device. In the described preferred embodiment, an appropriate "button" which has been used as the attachment hardware is that sold by PRYM/DRITZ, model 36".

Attached Object

After the ball body 10 and the attachment hardware 20 have been connected, an external object can be attached to the loop 23. In the most preferred construction, a key chain 30 is attached thereto. As shown in FIG. 1, the key chain 30 preferably includes a ring 31 attached to loop 23, a chain 32 extending from the ring 31, and a key holder 33 at the distal end of the chain 32. Alternatively, the loop 23 can be used to anchor another object such as a tether (e.g., to facilitate carrying the device), a hook, or a necklace or the like.

The attached object enables the exerciser to be more interesting and versatile. The use of a key chain, or another "useful" or "needed" object, provides one with an incentive to carry the exerciser throughout the day, making it more accessible and less likely to be lost. Further, if an advertisement, such as a logo 16, is printed on the side of the ball body, consumer exposure to the advertisement will likely be increased.

Advantages

Some of the advantages discussed above and additional advantages are as follows. As should be apparent, the below listed advantages are not necessarily applicable to every aspect of the invention.

1. Secure Construction

The preferred construction enables an object to be fixedly attached to the balloons in a manner to avoid tearing or damaging the balloons, despite the difficulties involved in attaching an object to a thin elastomeric material.

2. Availability Of Parts

The present device can be easily and inexpensively manufactured from readily available parts. Manufacture can be performed with almost no modification of commercially available parts—e.g. the balloons are easily cut along a "straight" line at the neck thereof to create a "circular" opening.

3. Easy Snap Engagement

The preferred form of the device is snap engaged, which is clean and easy to effect—for example, when attached by hand. No other parts are needed which would require separate handling and/or manipulation.

4. Adaptability Of Product

Because of the snap fit engagement, the product can be designed to be un-snapped so the outer balloon 13 can be replaced, or other balloons can be placed thereover. The product can also be unsnapped to add or to remove particulate material as desired, enabling the repair of improperly filled devices by the manufacturer and/or alteration of the device by the user.

According to another embodiment, the user can be provided with a plurality of outer balloons whereby (a) tension of the device can be modified by applying different thicknesses, elasticities, or numbers of balloons and (b) the color or decorative printing can be selectively changed.

5. Finished Appearance

The present device can be constructed such that the balloon opening is not noticed by the user due to the attachment hardware, creating a professionally manufactured appearance.

6. Reduced Risk Of Loss

The present device can include a key chain or other "useful" or "needed" object which reduces the risk of misplacing or losing the exerciser.

While the present invention has been shown and described with reference to preferred embodiments presently contemplated as best modes for carrying out the invention, it is understood that various changes may be made in adapting the invention to different embodiments without departing from the broader inventive concepts disclosed herein and comprehended by the claims which follow.

What is claimed is:

1. A hand held exerciser and key chain assembly, comprising:

a) a ball body including a plurality of elastomeric balloon layers and a material packed within an innermost one of said balloon layers;

b) said balloon layers each having an opening therethrough;

c) an inner attachment member having an outer diameter greater than the diameter of at least the opening of an outermost one of said balloon layers, said inner attachment member being situated within at least said outermost balloon layer;

d) a loop connected to said inner attachment member and extending through said opening in said outermost balloon layer;

e) an outer attachment member having a hole through which said loop extends, said outer attachment member having an outer diameter greater than said diameter of at least said opening of said outermost balloon layer;

f) said inner and outer attachment members having respective snap engagement portions which snap fit said inner and outer attachment members together;

g) a chain having an inner end attached to said loop;

h) a key holding loop attached to a distal end of said chain.

2. The assembly of claim 1, wherein there are three of said balloon layers.

3. The assembly of claim 2, wherein said outermost of said three balloon layers has indicia printed on an outer surface thereof.

4. The assembly of claim 2, wherein said openings of the middle and outermost of said three balloon layers are aligned with one another and generally opposite to said opening of the innermost of said three balloon layers, said inner attachment member being situated within both said middle and outermost of said three balloon layers.

5. The assembly of claim 1, wherein said inner attachment member includes a bowl having a bottom surrounded by a perimeter sidewall and a plurality of resilient teeth extending inward and downward from a top of said sidewall, said loop extends upward from a center area of the bottom, said outer attachment member includes an disc having a slot therein for receiving said loop and an inwardly angled peripheral wall around the disc, and said snap engagement portions include said resilient teeth and said angled peripheral wall.

6. The assembly of claim 1, wherein said material includes at least one particulate material selected from the group consisting of sand, baking soda, corn starch, floor, glass beads, plastic beads, and metal beads, and said particulate material has a particle diameter in the range of about 0.001 to 0.04 inches.

7. The hand exerciser of claim 1, wherein said opening in said outermost balloon layer is the only opening in said outermost balloon layer such that said outermost balloon layer obstructs the view of and fully encloses contents therein.

8. A hand exerciser, comprising:

a) an exerciser ball having at least one elastomeric balloon layer and a material filled within an innermost one of said balloon layers;

b) at least an outermost one of said balloon layers having an opening therethrough;

c) attachment hardware having an outer clamping member and an inner clamping member clamping at least said outermost balloon layer around the perimeter edge of said opening; and d) said attachment hardware including a connecting member for attachment to an external object, wherein said connecting member is a loop fixed to said inner clamping member, and said outer clamping member has a slot therein for receiving said loop.

9. The hand exerciser of claim 8, including an external object attached to said loop.

10. The hand exerciser of claim 9, wherein said external object is a key chain.

11. The hand exerciser of claim 8, further including indicia printed on an outer surface of an outermost one of the balloon layers.

12. The hand exerciser of claim 8, wherein there is only one of said balloon layers such that said outermost one of said balloon layers is the same as said innermost one of said balloon layers.

13. The hand exerciser of claim 8, wherein said exercise ball is sized so as to fit in one hand of a user to be squeezed by the user.

14. The hand exerciser of claim 13, wherein said balloon layers have a volume of approximately ⅓ cup.

15. The hand exerciser of claim 8, wherein said exercise ball is sized so as to fit in one hand of a user to be squeezed by the user.

* * * * *